US006345819B1

(12) United States Patent
Bae

(10) Patent No.: US 6,345,819 B1
(45) Date of Patent: Feb. 12, 2002

(54) PAPER FEEDING APPARATUS IN A PRINTER

(75) Inventor: Sang-Jin Bae, Suwon (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/510,513

(22) Filed: Feb. 22, 2000

(30) Foreign Application Priority Data

Feb. 19, 1999 (KR) ..... 2526-99

(51) Int. Cl.[7] ..... B65H 5/06

(52) U.S. Cl. ..... 271/272; 271/264; 271/273; 271/314

(58) Field of Search ..... 271/272, 273, 271/274, 264, 314

(56) References Cited

U.S. PATENT DOCUMENTS 2,828,123 A * 3/1958 Guillemette ..... 271/314
3,606,309 A * 9/1971 Petrick et al. ..... 271/272
3,713,735 A * 1/1973 Wilber ..... 271/272
5,734,404 A * 3/1998 Komupo et al. ..... 271/272
5,800,076 A * 9/1998 Umeda ..... 271/274
6,168,270 B1 * 1/2001 Saikawa et al. ..... 271/264

* cited by examiner

*Primary Examiner*—H. Grant Skaggs
(74) *Attorney, Agent, or Firm*—Robert E. Bushnell, Esq.

(57) ABSTRACT

A paper feeding apparatus of a printer is provided. The paper feeding apparatus includes a plurality of paper guide ribs formed by protruding from one side of a rectangular hole of a base frame toward the other side of a rectangular hole and a plurality of rib receiving grooves formed on a feed roller positioned in the rectangular hole and corresponding to the paper guide ribs. With the paper guide ribs and the rib receiving grooves, the paper feeding apparatus prevents paper jam occurring when the upper end of a paper is caught in the rectangular hole and also prevents deterioration of print quality by uniformly maintaining the gap between a nozzle of an ink cartridge and a printable sheet of paper.

27 Claims, 4 Drawing Sheets

PAPER FEEDING APPARATUS IN A PRINTER

CLAIM OF PRIORITY

This application makes reference to, incorporates the same herein, and claims all benefits accruing under 35 U.S.C. §119 from an application for STRUCTURE FOR FEEDING PAPER OF PRINTER earlier filed in the Korean Industrial Property Office on Feb. 19, 1999 and there duly assigned Ser. No. 2526/1999.

BACKGROUND OF THE INVENTION

1. Field of the Invention

This invention relates to a paper feeding apparatus in a printer, and more specifically, a paper feeding apparatus including a paper guiding member disposed on a paper feeding path in a printer.

2. Description of the Related Art

A paper guiding apparatus is installed on a paper path in a printer. A cut sheet of paper fed from a cassette passes through the paper path and is loaded into a main body of the printer. Typically, the paper guiding apparatus includes a feeding roller rotating by a motor and feeding the cut sheet into the main body of the printer while rotating, a friction roller disposed to push against the feeding roller, and a base frame supporting said sheet of paper fed by feeding roller and disposed between the main body and the feeding roller to guide the cut sheet of paper from the feeding roller to the main body of the printer. The cut sheet of paper introduced between the friction roller and the feeding roller is fed by rotation power of the feeding roller and friction power of the friction roller while the base frame supports the sheet of paper fed out from the feeding roller.

The paper guiding apparatus, however, can not continue to feed the cut sheet of paper when one end of the cut sheet is curled and caught by a component of the base frame or the roller while being fed. Ink injected from an ink cartridge can not be properly sprayed on the cut sheet of paper, and this causes poor printing quality.

A conventional ink-jet printer is shown in FIGS. 1 and 2. The printer performs a printing job in such a manner that the ink is sprayed on a cut sheet of paper P while the cut sheet is fed in the direction of arrow A and fed into a base frame 6 by a feed roller 4 and a friction roller 5. An ink cartridge 3 reciprocates along a guide bar 2 installed in a printing area of a printer body 1.

Feed roller 4 protrudes upwardly through a rectangular hole 7 formed on base frame 6 and comes in contact with friction roller 5. Friction roller 5 is rotatably installed at one end of a friction holder 8 and disposed to push against feed roller 4. A nozzle 3*a* is formed at a bottom side of ink cartridge 3, and the ink injected through nozzle 3*a* is sprayed on the cut sheet which is fed out from feed roller and supported by a base frame 6. A deflector guide 9 is installed to guide the supply of sheets of paper contained in a cassette.

FIGS. 3A and 3B are top views of a feed roller and a base frame, respectively. In the event that cut sheets of paper are continuously fed into the conventional ink jet printer under a condition that an front end of the cut sheet is curled, that the front end of the cut sheet is not properly supplied through the paper feeding path, and that the cut sheet is caught into hole 7 of base frame 6. The ink can not be properly sprayed on the sheet of paper.

The entire area of the base frame 6 includes a plurality of holes 7 to allow the feed roller to protrude through the hole 7. However, feed roller 4 is disposed to be too close to nozzle 3*a* of ink cartridge 3 when hole 7 is entirely opened to the sheet of paper. This results in an uneven gap between nozzle 3*a* and the cut sheet of paper P and causes a deteriorated print in quality.

SUMMARY OF THE INVENTION

It is an object of the present invention to provide an improved paper feeding apparatus suitable to guide a sheet of paper passing through a paper path in a straight manner.

It is another object of the present invention to provide a paper feeding apparatus suitable to prevent paper jam when a front end of a cut sheet of paper is curled and fed into a feeding path.

It is yet another object to provide a paper feeding apparatus able to achieve high print quality by suppressing a gap between the nozzle of the ink cartridge and a printable side of the paper.

It is still another object to provide a paper feeding apparatus able to uniformly maintain the high quality of printing operations.

It is a further object to provide a paper feeding apparatus able to perform a printing operation without any deterioration of print quality.

These and other objects may be achieved by providing a paper feeding apparatus including a feed roller rotating by an axle connected to a motor, a friction roller disposed to push against the feed roller and rotating by friction while pushing against the feed roller, a base frame disposed on one output of the friction roller and the feeding roller to support the sheet of paper, rectangular holes formed on the base frame, a plurality of paper guide ribs formed on one side of the rectangular hole of the base frame and protruding from the one side and being extended toward the other side of the rectangular hole, and a plurality of rib receiving grooves formed on a feed roller and corresponding to the paper guide ribs. The ribs are disposed on the respective rib receiving grooves when the feed roller protrudes through the rectangular hole. By inserting the ribs into the grooves, the base frame is level with a top portion of the feed roller and guides the cut sheet in the straight manner from feed roller to the base frame, maintains the same level of the front end of cut sheet fed out from the feed roller, and supports the cut sheet to be located closer to the nozzle.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
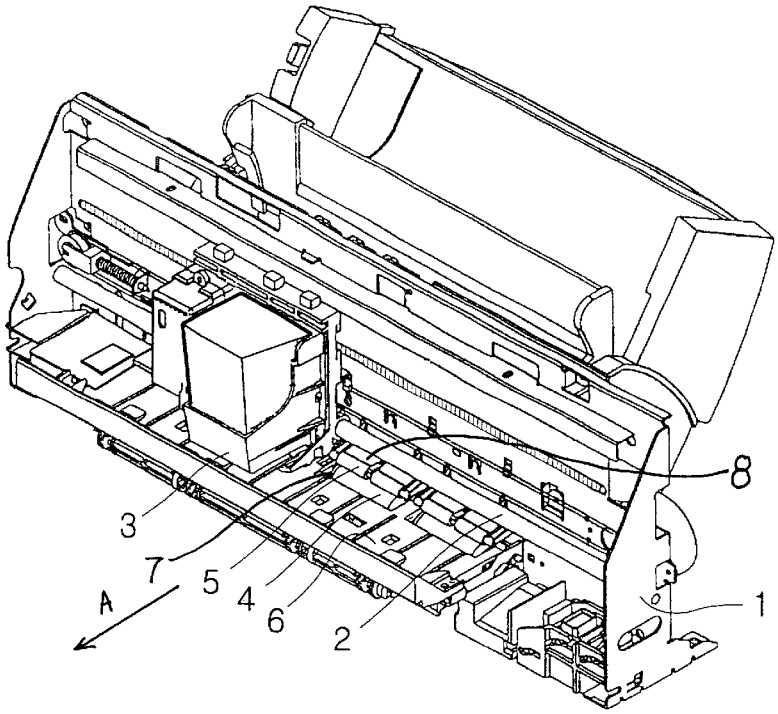
Fig. 1 (Prior Art)
FIG. 1 is a perspective view of a conventional printer.
Figure 2:
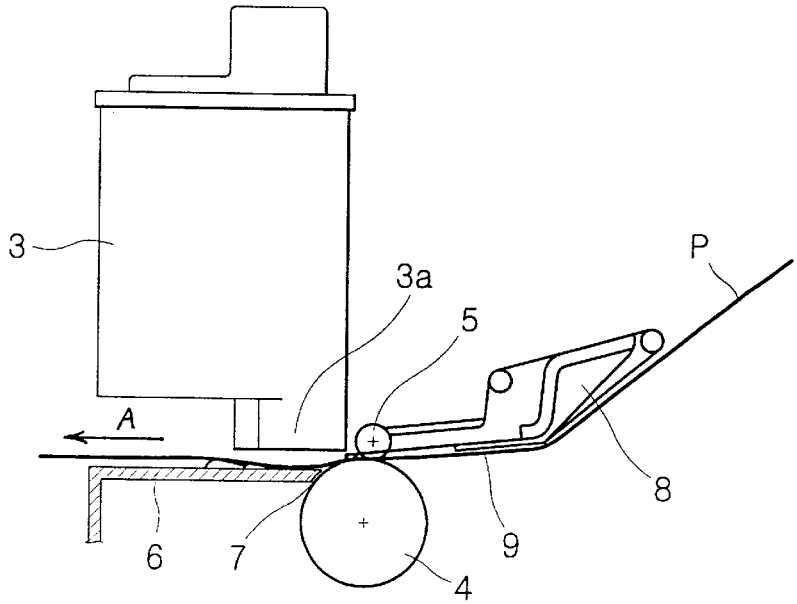
Fig. 2 (Prior Art)
FIG. 2 is a side view of a conventional paper feeding apparatus of FIG. 1.
Figure 3A:
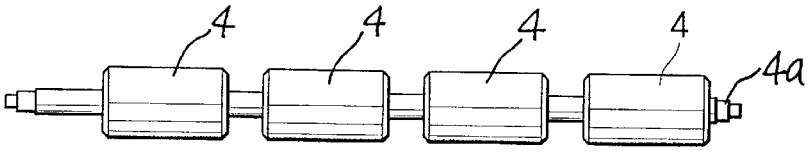
Fig. 3A (Prior Art)
FIGS. 3A and 3B are top views of a feed roller and base frame, respectively of FIG. 1.
Figure 3B:
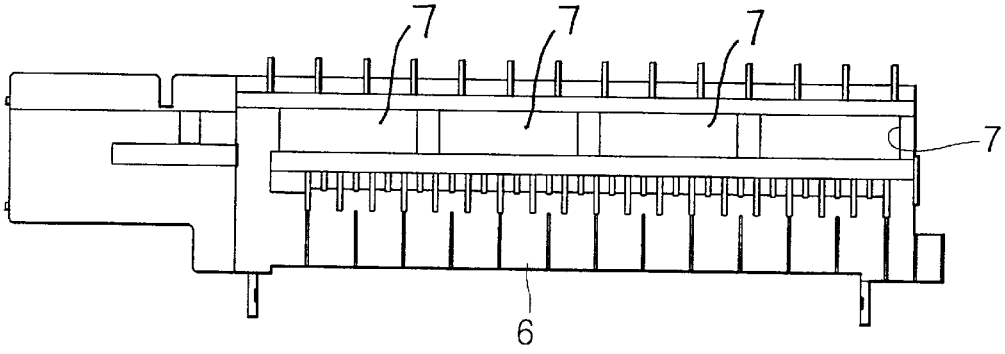
Fig. 3B (Prior Art)
Figure 4:
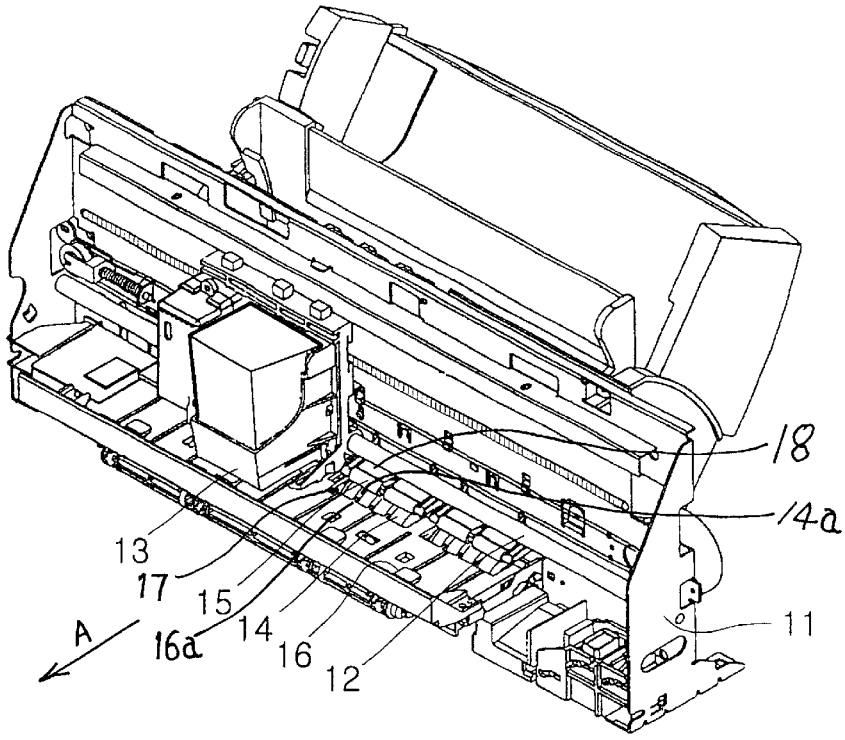
FIG. 4 is a perspective view of a printer according to the principle of the present invention.
Figure 5:
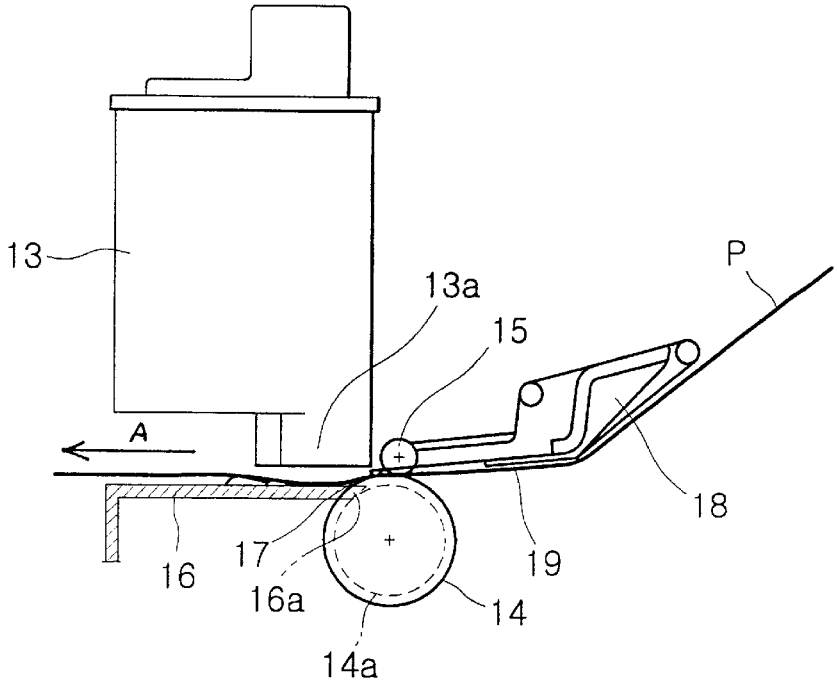
FIG. 5 is a side view of a paper feeding apparatus of FIG.4.

Referring now to FIGS. 4 through 6*a* and 6*b,* a paper feeding apparatus includes an ink cartridge 13 reciprocating along a guide bar 12 installed in a print area of a main body 11 of an ink-jet printer. Under the ink cartridge 13, a base frame 16 is installed. A feed roller 14 and a friction roller 15 for feeding sheets of paper are installed at an end of the base frame 16 in such a manner that feed roller 14 and friction roller 15 pushes against each other.

Friction roller 15 is rotatably installed at one end of a friction holder 18. A deflector guide 19 for guiding the sheet of paper transferred from a cassette between feed roller 14 and friction roller 15 is installed on friction holder 18. Reference numeral 13*a* represents a nozzle formed on ink cartridge 13, and reference numeral 17 represents rectangular holes formed through base frame 16.

Figure 6A:
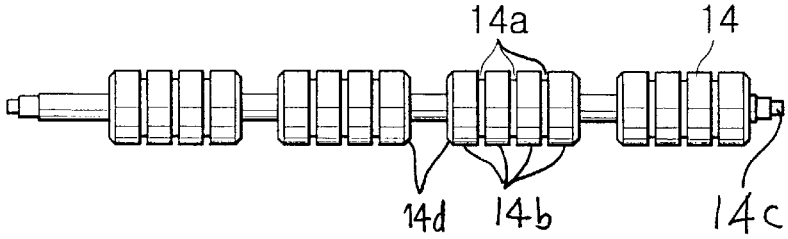
FIGS. 6A and 6B are top views of a feed roller and a base frame of FIG. 4.
Figure 6B:
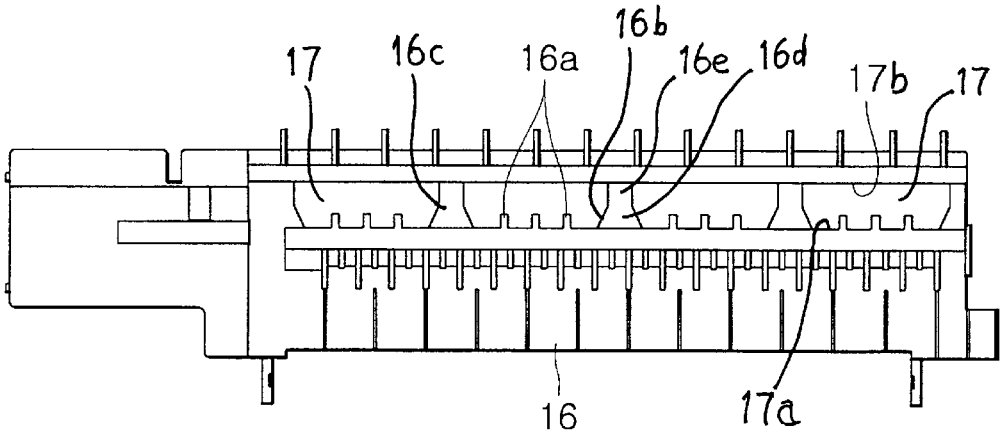

As shown in FIGS. 6A and 6B, a plurality of guide ribs 16*a* are formed on peripheral surface 17*a* of rectangular holes 17. Guide ribs 16*a* protruding from peripheral surface 17*a* or 17*b* of rectangular holes 17 are extended toward a direction or a reverse direction of arrow A. Guide ribs 16*a* can be formed on both sides 17*a* and 17*b* of rectangular holes 17. Guide ribs 16*a* protrude from one side 17*a* of rectangular hole 17 and are extended toward the other side 17*b* of rectangular hole 17. Each rectangular hole 17 including guide ribs 16*a* are spaced-apart from each other by a spacer 16*c* which has a wide portion 16*d,* a narrow portion 16*e*, and a slant portion 16*b.*

Each feed roller 14 having a cylindrical shape is fixed to an axle 14*c* and rotates about an axis passing through a center of axle 14*c*. A plurality of grooves 14*a* are formed on an outer circumferential surface of each feed roller 14. Each groove 14*a* is corresponding to each guide rib 16*a*. A cylindrical roller 14*b* formed between grooves 14*a* of each feed roller 14 is disposed between guide ribs. A cutout portion 14*d* is formed on each cylindrical roller 14*b* located outside of each feed roller 14. Spacer 16*c* is disposed between feed rollers 14. A slant portion 16*b* is corresponding to cutout portion 14*d* of cylindrical roller 14*a* of feed roller 14 and is inserted between feed rollers 14 when feed roller 14 protrudes through rectangular hole 17 of base frame 16. Also, the ribs are disposed to be inserted into grooves 14*a* when feed roller 14 protrudes through rectangular hole 17.

Base frame 16 is level with a top portion of feed roller 14 when feed roller 14 protrudes through rectangular hole 17, ribs 16*a* are inserted into grooves 14*a,* and spacer 16*c* is disposed between feed rollers. This leveling of base frame 16 and feed roller 14 reduces a gap between cut sheet P and nozzle 13*a*. An upper surface of each rib 16*a* is located between a top surface of feed roller 14 and a lower surface of groove 14*a*. Base frame 16 includes an upper surface preventing the sheet of paper from falling down under a level of a bottom surface of groove 14*a*. rib 16*a* supports a front portion of the sheet of paper before the front portion of the sheet of paper contacts a side 17*a* or 17*b* of hole 17 of base frame 16. Also, base frame 16 guides cut sheet P in the straight manner from feed roller 14 to base frame 16, maintains the same level of the front end of cut sheet P fed out from feed roller 14, and supports cut sheet P to be located closer to the nozzle 13*a*. The rib 16*a* is extended from a side of hole 17 toward a reverse direction of feeding the sheet of paper and has a first width while said groove has a second width. Second width of groove 14*a* is wide enough to is accommodate the insertion of rib 16*a* and narrow enough to reduce a gap between rib 16*a* and groove 14*a* without interfering the rotation of feed roller 14.

The operation of the paper feeding apparatus according to the principle of the present invention will be described hereinafter. Even though a sheet of paper with a curled portion of one end of the sheet of paper is fed by feed roller 14, the sheet of paper is guided by the deflector guide 19, introduced between feed roller 14 and friction roller 15, released from friction roller 15, and transferred on paper guide ribs 16*a* of base frame 16. A top portion of feed roller 14 is level with paper guide ribs because paper guide ribs are inserted into grooves 14*a* formed on feed roller 14. The front end of cut sheet P released from feed roller 14 is introduced between paper guide ribs 14*a* and nozzle 13*a* without significant elevation between base frame 16 and the top portion of feed roller 14. Accordingly, the curled portion of the sheet of paper is not caught in the rectangular hole 17 of base frame 16 because the curled portion of the sheet of paper is guided by paper guide ribs before inserted between the sides of rectangular hole 17 of base frame 16 and outer circumferential surfaces of feed roller 14. Thus, paper jam does not occur on the feeding path even if the one end of the sheet of paper is curled during being fed.

In other words, since paper guide ribs 16*a* of base frame 16 are in gear with grooves 14*a* of feed roller 14, the sheet of paper is guided to the base frame 16 from feed roller 14 in a straight manner and is not caught in the rectangular hole 17. Moreover, paper guide ribs 16*a* prevent the paper from sagging, which results in a uniformly maintained gap between the nozzle 13*a* of the ink cartridge 13 and the print side of the paper. Therefore, printing operation can be properly performed without any deterioration of print quality.

As described above, the paper feeding apparatus of a printer according to the principle of the present invention is capable of preventing paper jam occurring when the upper end of the sheet of paper is caught in the rectangular hole of the base frame and uniformly maintaining the gap between the nozzle of the ink cartridge and the printable side of the sheet of paper so that print quality is uniformly maintained. The paper guide ribs guide the upper end of a paper when the paper is fed into the printer in order to maintain high quality prints.

This invention has been described above with reference to the aforementioned embodiments. It is evident, however, that may alternatives, modifications and variations will be apparent to those having skill in the art in light of the foregoing description. Accordingly, the present invention embraces all such alternatives, modifications and variations as fall within the spirit and scope of the appended claims and their equivalents.

What is claimed is:

1. A paper feeding apparatus, comprising:

at least one feed roller fixed to an axle, rotating by said axle;

a friction roller engaged with said feed roller, disposed to push against said feed roller, rotating by friction force between said friction roller and said feed roller;

said feed roller feeding a cut sheet of paper introduced between said friction roller and said feed roller into a printing area;

a base frame disposed on said printing area to support the cut sheet fed out from said feed roller;

a hole formed on said base frame, accommodating said feed roller to protrude through said hole while said feed roller feeds the cut sheet into said printing area;

a plurality of grooves formed on an outer circumferential surface of said feed roller; and a plurality of ribs formed on a portion of an edge surrounding said hole, each inserted into said corresponding groove when said feed roller protrudes through said hole formed on base frame.

2. The apparatus of claim 1, further comprised of each rib being level with a top surface of said feed roller while inserted into each groove.

3. The apparatus of claim 1, further comprised of an upper surface of each rib located between a top surface of said feed roller and a lower surface of said groove.

4. The apparatus of claim 1, with said base frame having an upper surface preventing the cut sheet of paper from falling down under a level of a bottom surface of said groove.

5. The apparatus of claim 1, with said rib supporting a front portion of the cut sheet of paper before said front portion of the sheet of paper contacts a second portion of said edge of said base frame.

6. The apparatus of claim 1, with said rib extended from said portion of said edge toward a reverse direction of feeding the sheet of paper.

7. The apparatus of claim 1, with said rib having a first width while said groove has a second width wider than said first width.

8. The apparatus of claim 1, with base frame comprising a plurality of holes each defined by said edge and a plurality of said ribs.

9. The apparatus of claim 8, further comprised of a plurality of feed rollers spaced-apart from each other by a gap, each of said feed rollers having said grooves.

10. The apparatus of claim 9, further comprised of a spacer formed between said holes of said base frame and disposed between said feed rollers.

11. The apparatus of claim 10, with said spacer including a first plate and a second plate, said first plate having the same width as said gap, said second plate having a width and inserted between cutout portions formed on said feed rollers while said feed roller protrudes through said hole.

12. A paper feeding apparatus, comprising:

a feed roller rotatably installed along a path of conveyance of a cut sheet of paper through said apparatus, feeding said cut sheet;

a friction roller disposed to push against said feed roller, rotating by friction force between said friction roller and said feed roller, feeding the cut sheet introduced between said friction roller and said feed roller into an printing area;

a base frame disposed on said printing area to support the cut sheet fed out from said feed roller and said friction roller;

a hole formed on said base frame, accommodating said feed roller to protrude through said hole while said feed roller feeds the cut sheet into said printing area;

a groove formed on an outer circumferential surface of said feed roller; and a rib formed on a first portion of an edge surrounding said hole, inserted into said groove while said feed roller protrudes through said hole formed on said base frame and rotates.

13. The apparatus of claim 12, with said rib located within said groove while a second portion of said edge is disposed adjacent to said outer circumferential surface of said feed roller.

14. The apparatus of claim 12, further comprised of said rib being level with a top surface of said feed roller while inserted into each groove.

15. The apparatus of claim 12, further comprised of an upper surface of said rib located between a top surface of said feed roller and a lower surface of said groove in order to prevent the sheet of paper from falling down under said lower surface of said groove.

16. The apparatus of claim 12, with said rib supporting a front portion of the sheet of paper before said front portion of the sheet of paper contacts a second portion of said edge of said base frame.

17. The apparatus of claim 12, with said rib extended from said portion of said edge toward a reverse direction of feeding the sheet of paper.

18. The apparatus of claim 12, with said rib having a first width while said groove has a second width wider than said first width.

19. The apparatus of claim 12, with said base frame comprising a plurality of said holes defined by a rectangular shaped edge and having a plurality of said ribs.

20. The apparatus of claim 19, further comprised of a plurality of feed rollers being spaced-apart from each other by a gap, each of said feed rollers having a plurality of said grooves.

21. The apparatus of claim 20, further comprised of a spacer formed between said holes disposed between said feed rollers, including a first plate and a second plate, said first plate having the same width as said gap, said second plate having a width and inserted between cutout portions formed on said feed rollers while said feed roller protrudes through said hole.

22. A paper feeding apparatus, comprising:

a printer body;

a base frame bearing a hole, said base frame being installed along a path of conveyance of a cut sheet of paper through said apparatus;

a feed roller rotatably installed beneath said base frame, protruding upwardly through said hole in said base frame, feeding the cut sheet of paper into said printer body;

a friction roller installed over said feed roller in contact with said feed roller, rotating by rotation of said feed roller;

a guide member formed on a portion of an edge surrounding said hole, guiding the cut sheet transferred from said feed roller toward a printing area of said printer body; and a groove formed on an outer periphery of said feed roller, accommodating the insertion of said guide member.

23. The apparatus of claim 22, with said guide member disposed within said groove while a second portion of said edge of said base frame is disposed adjacent to said outer circumferential surface of said feed roller.

24. The apparatus of claim 22, further comprised of said guide member being level with a top surface of said feed roller while inserted into said groove.

25. The apparatus of claim 22, further comprised of an upper surface of said guide member located between a top surface of said feed roller and a lower surface of said groove, preventing the cut sheet from being inserted between said edge and said feed roller.

26. The apparatus of claim 22, with said guide member supporting a front portion of the sheet of paper before said front portion of the sheet of paper contacts a second portion of said edge of said base frame.

27. The apparatus of claim 22, wherein a plurality of said guide members formed on said portion of said edge surrounding respective said hole in said base frame while a plurality of said grooves are formed on said feed roller.

* * * * *